US006793742B2

(12) United States Patent
Sakaki et al.

(10) Patent No.: US 6,793,742 B2
(45) Date of Patent: Sep. 21, 2004

(54) PREPARATION OF BONDED RARE EARTH MAGNET-FORMING ALLOY AND BONDED RARE EARTH MAGNET COMPOSITION

(75) Inventors: Kazuaki Sakaki, Takefu (JP); Koji Sato, Takefu (JP); Takahiro Hashimoto, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/151,096

(22) Filed: May 21, 2002

(65) Prior Publication Data

US 2003/0062098 A1 Apr. 3, 2003

(30) Foreign Application Priority Data

May 29, 2001 (JP) ..... 2001-161165

(51) Int. Cl.[7] ..... H01F 1/055

(52) U.S. Cl. ..... 148/104; 148/101; 164/463; 164/477; 252/62.54

(58) Field of Search ..... 252/62.54; 148/101, 148/102, 103, 104; 164/463, 477

(56) References Cited

U.S. PATENT DOCUMENTS 5,888,417 A * 3/1999 Akioka et al. ..... 252/62.55
6,001,272 A * 12/1999 Ikuma et al. ..... 252/62.54
6,527,971 B1 * 3/2003 Nakamura et al. ..... 252/62.54

FOREIGN PATENT DOCUMENTS

| | | | |
|---|---|---|---|
| JP | 56-102533 | A | 8/1981 |
| JP | 4-146604 | A | 5/1992 |
| JP | 4-152603 | A | 5/1992 |
| JP | 7-57909 | A | 3/1995 |
| JP | 8-260083 | A | 10/1996 |
| JP | 2001-126906 | A | 5/2001 |

* cited by examiner

*Primary Examiner*—Roy King
(74) *Attorney, Agent, or Firm*—Birch, Stewart, Kolasch & Birch, LLP

(57) ABSTRACT

An alloy powder for bonded rare earth magnets is prepared by melting an alloy consisting essentially of 20–30 wt % of Sm or a mixture of rare earth elements (inclusive of Y) containing at least 50 wt % of Sm, 10–45 wt % of Fe, 1–10 wt % of Cu, 0.5–5 wt % of Zr, and the balance of Co, quenching the melt by a strip casting technique, to form a rare earth alloy strip containing at least 20% by volume of equiaxed crystals with a grain size of 1–200 $\mu$m and having a gage of 0.05–3 mm, and heat treating the strip in a non-oxidizing atmosphere at 1000–1300° C. for 0.5–20 hours, followed by aging treatment and grinding.

6 Claims, 5 Drawing Sheets

PREPARATION OF BONDED RARE EARTH MAGNET-FORMING ALLOY AND BONDED RARE EARTH MAGNET COMPOSITION

This invention relates to a method for preparing an alloy for bonded $Sm_2Co_{17}$ base magnets and a bonded $Sm_2Co_{17}$ base magnet composition comprising the alloy.

BACKGROUND OF THE INVENTION

Bonded $Sm_2Co_{17}$ base magnet powder is traditionally prepared by milling an alloy ingot having a regulated composition to a particle size of about 1 to 10 microns, pressing and shaping the resulting powder in a magnetic field to form a powder compact, sintering the powder compact in an argon atmosphere at 1100 to 1300° C., and typically about 1200° C., for a time of 1 to 5 hours, followed by solution treatment. Next, the solution-treated compact is subjected to aging treatment in which it is held at a temperature of 700 to 900° C., and typically about 800° C., for about 10 hours, then gradually cooled to 400° C. or lower at a descending rate of −1.0° C./min. The sintered magnet is finally ground to a predetermined particle size. This powder metallurgy process, however, requires a more number of steps and a longer time than the sintered magnet producing process, and has the drawbacks of increased cost and low production efficiency.

In another traditional process, bonded $Sm_2Co_{17}$ base magnet powder is prepared by subjecting an alloy ingot having a regulated composition to solution treatment in an argon atmosphere at 1100 to 1300° C., and typically about 1200° C., followed by aging treatment in which it is held at a temperature of 700 to 900° C., and typically about 800° C., for about 10 hours, then gradually cooled to 400° C. or lower at a rate of −1.0° C./min. The treated ingot is finally ground to a predetermined particle size. The bonded rare earth magnet-forming alloy powder obtained by this process has the advantage of low cost, as compared with the bonded rare earth magnet-forming alloy powder obtained by the powder metallurgy process (involving grinding the once sintered rare earth magnet). However, the bonded $Sm_2Co_{17}$ base magnet powder obtained by this process is known to have magnetic properties which are affected by the crystalline state of the ingot following melting. Specifically, the bonded $Sm_2Co_{17}$ base magnet powder obtained from an ingot whose crystalline state is predominantly composed of chill crystals and equiaxed crystals has poor magnetic properties, especially low coercivity, whereas the bonded $Sm_2Co_{17}$ base magnet powder obtained from an ingot whose crystalline state is predominantly composed of columnar crystals has good magnetic properties, especially high coercivity (see JP-A 56-102533 and JP-A 7-57909).

It then becomes a common practice to cast a molten alloy into a mold such as a box-shaped mold so that the macroscopic structure is composed of columnar crystals. Although the cooling rate of molten alloy must be increased to a certain level in order to obtain columnar crystals, the casting process using a box-shaped mold has the tendency that the cooling rate in a central portion of the ingot is lower than the cooling rate above which columnar crystals form, resulting in a coarse-grained structure and generation of equiaxed crystals. This problem can be overcome by such means as reducing the thickness of an ingot or increasing the surface area of the mold in contact with the molten alloy (see JP-A 4-146604 and JP-A 4-152603). Since these means sacrifice production efficiency, an ingot of a certain thickness must be furnished, which often results in a coarse-grained structure and generation of equiaxed crystals. It is then difficult to obtain at the end of casting an ingot which is predominantly composed of columnar crystals. The coarse-grained structure and the generation of equiaxed crystals are the main reason why satisfactory magnetic properties are not available in the bonded $Sm_2Co_{17}$ base magnet powder.

One solution to the above problem is a casting technique using a single roll, known as strip casting technique, which results in more than 90% by volume of columnar crystals (see JP-A 8-260083). The ingot produced by this casting technique has a microcrystalline structure and a uniform alloy structure free of segregation. In the case of anisotropic bonded rare earth magnets, however, anisotropic bonded rare earth magnets having satisfactory magnetic properties cannot be manufactured unless all bonded rare earth magnet-forming powder particles are unidirectionally oriented. Since the ingot obtained by the strip casting technique has a microcrystalline structure, the bonded rare earth magnet-forming alloy must be ground into a fine powder or the ingot must be subjected to heat treatment and solution treatment to induce grain growth. However, in the former case wherein the bonded rare earth magnet-forming alloy is ground into a fine powder, a compositional shift readily occurs because of the susceptibility of fine particles to oxidation. There can be even the danger of ignition by instantaneous oxidation. Additionally, bonded magnets produced from the powder fail to have a sufficient packing density and satisfactory magnetic properties. In the latter case wherein the ingot obtained by the strip casting technique is subjected to heat treatment and solution treatment, since the ingot is in the form of flakes and thus has a large surface area, an extended period of solution treatment can cause the ingot to be degraded by leakage in the heat treating furnace, and Sm in the ingot to evaporate off. Then satisfactory magnetic properties are not obtained as well.

SUMMARY OF THE INVENTION

An object of the invention is to provide a method for preparing a bonded $Sm_2Co_{17}$ base magnet-forming alloy having improved magnetic properties; and a bonded magnet composition comprising the bonded $Sm_2Co_{17}$ base magnet-forming alloy and having improved magnetic properties.

The inventor studied the relationship of the structure of a $Sm_2Co_{17}$ base alloy to a structural change by heat treatment. It has been discovered that when a $Sm_2Co_{17}$ base alloy containing at least 20% by volume of equiaxed crystals with a grain size of 1 to 200 $\mu$m and having a strip gage of 0.05 to 3 mm or a $Sm_2Co_{17}$ base alloy obtained by quenching a corresponding alloy melt from a melt temperature of 1250 to 1600° C. by a strip casting technique is used, a homogeneous structure can be accomplished by a brief duration of heat treatment. By heat treating the alloy in a non-oxidizing atmosphere under the conditions specified below for allowing the average grain size to grow up, there are achieved magnetic properties which are improved over the manufacture of a bonded $Sm_2Co_{17}$ base magnet-forming alloy from a prior art cast ingot.

In one aspect, the invention provides a method for preparing an alloy for bonded rare earth magnets, comprising the steps of melting an alloy consisting essentially of 20 to 30% by weight of R which is samarium or a mixture of at least two rare earth elements (inclusive of Y) containing at least 50% by weight of samarium, 10 to 45% by weight of iron, 1 to 10% by weight of copper, 0.5 to 5% by weight of zirconium, and the balance of cobalt; quenching the melt by a strip casting technique, to form a rare earth alloy strip containing at least 20% by volume of equiaxed crystals with a grain size of 1 to 200 μm and having a gage of 0.05 to 3 mm; heat treating the strip in a non-oxidizing atmosphere at 1000 to 1300° C. for 0.5 to 20 hours; followed by aging treatment and grinding.

In another aspect, the invention provides a method for preparing an alloy for bonded rare earth magnets, comprising the steps of melting an alloy of the same composition as above; quenching the melt from a melt temperature of 1250 to 1600° C. by a strip casting technique; heat treating the resulting rare earth alloy in a non-oxidizing atmosphere at 1000 to 1300° C. for 0.5 to 20 hours; followed by aging treatment and grinding.

A further embodiment of the invention is a bonded rare earth magnet composition comprising the bonded rare earth magnet-forming alloy obtained by either of the above methods and 1 to 10% by weight of a resin.

In the manufacture of a bonded $Sm_2Co_{17}$ base magnet-forming alloy, when a $Sm_2Co_{17}$ base alloy is subjected to solution treatment at high temperature and for a long time, samarium evaporates off due to its very high vapor pressure, eventually inviting a compositional shift. As a result, the bonded rare earth magnet obtained therefrom suffers degradation of magnetic properties, and typically substantial variation of coercivity. On the other hand, if the temperature or time of solution treatment is reduced in order to avoid the evaporation of Sm, the heat treatment becomes less effective, resulting in declines of remanence and maximum energy product. In contrast, using a rare earth alloy containing at least 20% by volume of equiaxed crystals with a grain size of 1 to 200 μm and having a strip gage of 0.05 to 3 mm, which has been quenched by the strip casting technique, the present invention permits optimum solution treatment to be accomplished within a brief time. The use of the specific alloy allows the crystal grain size to grow up without entailing a compositional shift. Then the sequence of solution treatment, aging treatment and grinding to an optimum particle size yields a bonded $Sm_2Co_{17}$ base magnet-forming powder having improved magnetic properties. Using this bonded rare earth magnet-forming alloy and a resin as the raw material, a bonded rare earth magnet having improved magnetic properties can be produced.

DESCRIPTION OF THE PREFERRED EMBODIMENTS

Figure 1:
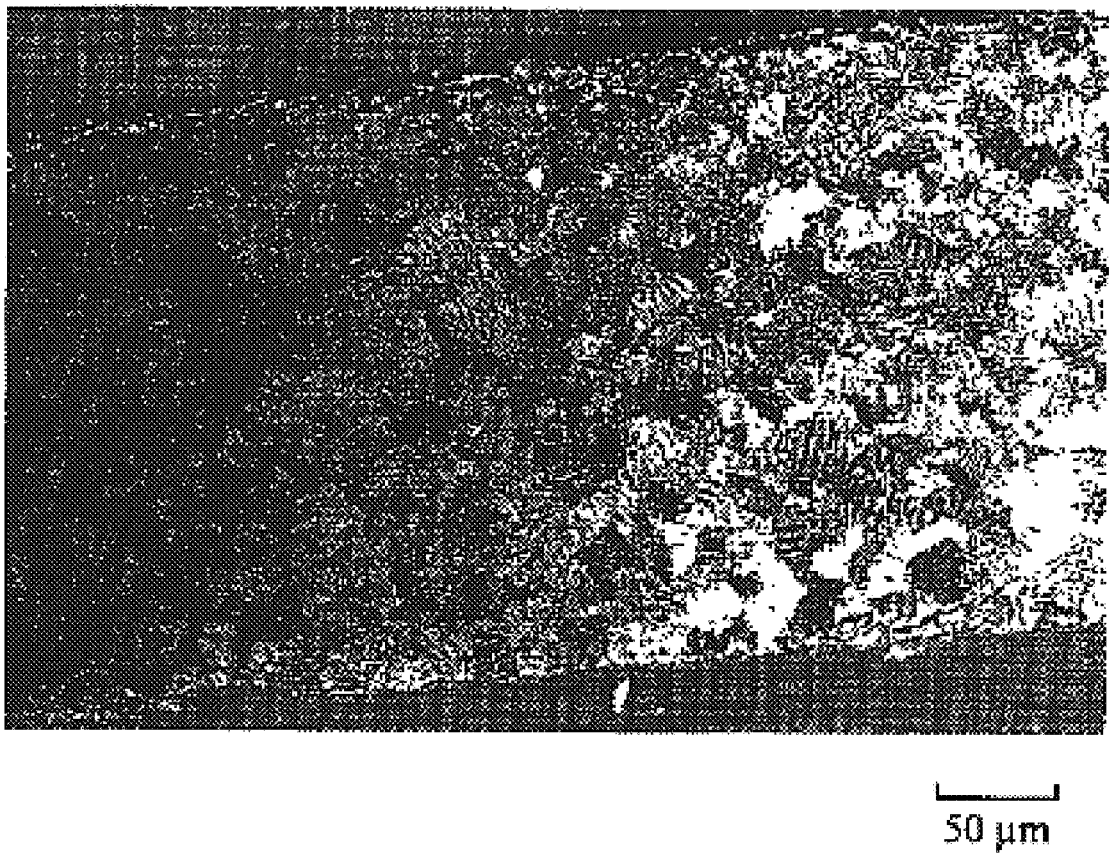
FIG. 1 is a photomicrograph under polarizing microscope of the bonded $Sm_2Co_{17}$ base magnet-forming alloy strip in Example 1.

The rare earth alloy ($Sm_2Co_{17}$ base permanent magnet alloy) used herein as a starting charge has a composition consisting essentially of 20 to 30% by weight of samarium (Sm) or a mixture of at least two rare earth elements containing at least 50% by weight of samarium, 10 to 45% by weight of iron (Fe), 1 to 10% by weight of copper (Cu), 0.5 to 5% by weight of zirconium (Zr), and the balance of cobalt (Co) and incidental impurities. The rare earth elements are inclusive of yttrium (Y), and the rare earth elements other than Sm, which are used herein, include Y, Nd, Ce, Pr and Gd, but are not limited thereto. Effective magnetic properties are not obtainable when mixtures of rare earth elements containing less than 50% by weight of Sm are used as the rare earth and when the rare earth content is less than 20% or more than 30% of the weight of the alloy composition.

According to the invention, the $Sm_2Co_{17}$ base permanent magnet alloy of the composition indicated above as the starting charge is melted by high-frequency heating in a non-oxidizing atmosphere such as argon or nitrogen. The alloy melt is then quenched by the strip casting technique from a melt temperature of 1250° C. to 1600° C. If the melt temperature prior to quenching is below 1250° C., the temperature span for quenching is so narrow that very large crystals having a grain size of more than 200 Am can form, leading to a non-uniform composition. At such lower temperature, the melt remains so viscous and makes it difficult to form a thin strip with a gage of 3 mm or less. Additionally, the melt can solidify midway the quenching process, failing to achieve sound casting. Preferably quenching is done from a melt temperature of 1300° C. or higher. Melt temperatures of higher than 1600° C. cause substantial evaporation of Sm during melting, entailing a compositional shift and preventing consistent manufacture. Preferably quenching is started from a melt temperature of 1500° C. or lower.

The strip casting yields a rare earth alloy strip which has a gage of 0.05 to 3 mm and contains at least 20% by volume of equiaxed crystals or grains with a grain size of 1 to 200 μm, for the reasons described below. If the grain size in the strip is very small, the growth rate of grains during subsequent heat treatment becomes so high that grains gradually grow into larger grains during the heat treatment by the mechanism that small grains are taken in larger grains. Namely, a smaller grain size accelerates grain growth. However, too small a grain size causes local variations of grain growth so that the grain size is not uniform after the heat treatment. Therefore, the crystals in the strip should have a grain size of 1 to 200 μm and preferably 5 to 100 μm.

The term "equiaxed crystals" are distinguishable from columnar crystals, which have unidirectionally solidified from the roll surface to a free surface, in that grains have only a little difference between their length and breadth and random crystal axis directions. In the alloy system used herein, equiaxed crystals with a grain size of 1 to 200 μm are formed by the mechanism that a number of nuclei which are crystal seeds are formed prior to solidification and when deprived of heat at the roll surface, they simultaneously crystallize. Then, to form equiaxed crystals, cooling is preferably started from a temperature just above the solidification temperature at which more nuclei are present. At this stage, many nuclei simultaneously crystallize to form equiaxed crystals, facilitating to provide a homogeneous structure. This avoids the segregation of equiaxed crystals with a size of several hundreds of microns as often found in the casting in a box-shaped mold. In addition, the equiaxed crystals have an aspect ratio (length/breadth ratio) which is close to that of heat treated crystals and can be heat treated within a shorter time than the columnar crystals having a substantial difference between length and breadth directions. If the strip contains at least 20% by volume of equiaxed crystals with a grain size of 1 to 200 μm, heat treatment can be completed within a short time because equiaxed crystals or grains are likely to enlarge and once enlarged grains further grow by taking smaller grains therein. In this way, a higher content of equiaxed crystals which are likely to induce uniform enlargement of grain size permits heat treatment to be completed within a shorter time. Then, the content of equiaxed crystals should preferably be 30% by volume or greater, more preferably 40% by volume or greater. The upper limit need not be set and may be 100% by volume. Where equiaxed crystals do not account for 100% by volume, the balance is columnar crystals or columnar crystals and chill crystals.

If the strip is too thin, it would be over-cooled on the roll so that crystal grains become smaller. To obtain an adequate grain size, the strip should have a gage of at least 0.05 mm. If the strip is too thick, cooling would become slow so that the grain size becomes larger. The strip should preferably have a gage of up to 3 mm. The strip gage is more preferably 0.1 to 1 mm.

In the formation of the thin strip, the roll should preferably be operated at a peripheral speed of 0.5 to 10 m/s during roll quenching. In the strip casting technique, the melt is alloyed by casting the melt onto a single roll or twin rolls for quenching. When cast onto the roll, the alloy melt should be at a temperature of 1250° C. to 1600° C.

Using the bonded $Sm_2Co_{17}$ base magnet-forming alloy indicated above, a bonded $Sm_2Co_{17}$ base magnet-forming alloy powder is prepared as follows. First, the ingot cast as above is heat treated in a non-oxidizing atmosphere such as argon or helium at a temperature of 1000 to 1300° C., especially 1100 to 1200° C. for 0.5 to 20 hours, especially 1 to 10 hours, thereby achieving an average grain size of preferably 20 to 300 $\mu$m, especially 30 to 200 $\mu$m. Heat treatment at a temperature below 1000° C. induces insufficient growth of crystal grains in the ingot whereas a temperature above 1300° C. induces sufficient growth of crystal grains, but brings the ingot to above its melting temperature, failing to form a homogeneous structure. With a heat treatment time of less than 0.5 hour, crystal grain growth becomes locally variant and insufficient. If heat treatment continues over 20 hours, the ingot can be degraded by any leakage of the heat treating furnace and Sm evaporate from the ingot, with the resultant tendency that satisfactory magnetic properties are lost. If the average grain size after heat treatment is less than 20 $\mu$m, the bonded rare earth magnet-forming alloy powder must be a fine powder, as previously described, which is susceptible to oxidation and hence, a compositional shift, and still worse, has the risk of ignition due to instantaneous oxidation. Additionally, in forming bonded magnets from such a fine powder, a sufficient packing density is not achievable, resulting in declines of remanence and maximum energy product. To obtain an average grain size of more than 300 $\mu$m, heat treatment must be done for a longer time or at a higher temperature, which causes the alloy structure to be degraded or detracts from the homogeneity of the structure, which in turn, adversely affects the magnetic properties of bonded $Sm_2Co_{17}$ base magnet-forming powder.

Next, the bonded $Sm_2Co_{17}$ base magnet-forming alloy is subjected to aging treatment of holding at a temperature in the range of 700 to 900° C., preferably 750 to 850° C., for 5 to 40 hours and then slowly cooling at a descending rate of −1.0° C./min. down to 400° C. or lower.

Subsequently, the bonded $Sm_2Co_{17}$ base magnet-forming alloy is ground to an appropriate particle size and mixed with 1 to 10% by weight, preferably 2 to 7% by weight of a resin, the balance (99 to 90%) being preferably the bonded magnet-forming alloy. The resin is typically selected from among an epoxy resin, nylon resin, acrylic resin, polyurethane, silicone resin, polyester, polyimide, polyethylene and polypropylene, but not limited thereto. After thorough mixing, the mixture is molded as by compression molding or injection molding, preferably in an applied magnetic field of 5 to 20 kOe and a pressure of 1 to 5 t/cm$^2$, thereby forming a bonded rare earth magnet of the desired shape. The invention is not limited to the indicated magnetic field and pressure. The alloy is preferably ground to an average particle size of 10 to 200 m, and preferably 30 to 100 $\mu$m, although the particle size varies with the particular application and desired magnetic properties of the bonded rare earth magnet. Grinding may be carried out, for example, in an inert gas atmosphere by means of a jaw crusher, Brown mill, pin mill or hydriding.

EXAMPLE

Examples are given below for the purpose of illustrating the invention and do not restrict the invention.

Example 1

A bonded $Sm_2Co_{17}$ base magnet-forming ingot was prepared by formulating a charge to a composition consisting essentially of 24.0 wt % Sm, 18.0 wt % Fe, 5.0 wt % Cu, 3.0 wt % Zr and the balance Co, placing the charge in an alumina crucible, melting it in an argon atmosphere in a high-frequency heating furnace, and casting from a melt temperature of 1350° C. by a strip casting technique, with a water-cooled single roll being operated at a peripheral speed of 1 m/s. FIG. 1 is a photomicrograph of the ingot under a polarizing microscope. The alloy consisted of crystals having an average grain size of 10 $\mu$m and containing 90% by volume of equiaxed crystals with a grain size of 1 to 200 $\mu$m and the balance of columnar crystals. The average grain size was determined from the polarized image under the polarizing microscope. It is noted that the average grain size is obtained by determining the diameter of a circle corresponding to the area of a crystal grain obtained from the polarized image and averaging the diameters. Hereinafter, the average grain size is obtained likewise.

Using a heat treating furnace, the bonded $Sm_2Co_{17}$ base magnet-forming ingot was heat treated in an argon atmosphere at 1180° C. for one hour. At the end of heat treatment, the ingot was quenched. For the bonded $Sm_2Co_{17}$ base magnet-forming alloy thus obtained, the Sm content was quantified by an ion exchange separation process and the average grain size was measured.

The bonded $Sm_2Co_{17}$ base magnet-forming alloy was held in an argon atmosphere at 800° C. for 10 hours, slowly cooled to 400° C. at a descending rate of −1.0° C./min, then ground to a particle size of no more than about 100 $\mu$m by a jaw crusher and Brown mill. In this way, a bonded rare earth magnet-forming alloy powder was obtained. To the alloy powder was added 5% by weight of an epoxy resin. The mixture was kneaded, placed in an applied magnetic field of 10 kOe for orientation, and molded under pressure, obtaining a bonded rare earth magnet. Magnetic properties of the bonded rare earth magnet were measured by means of a B–H tracer.

Comparative Example 1

Figure 2:
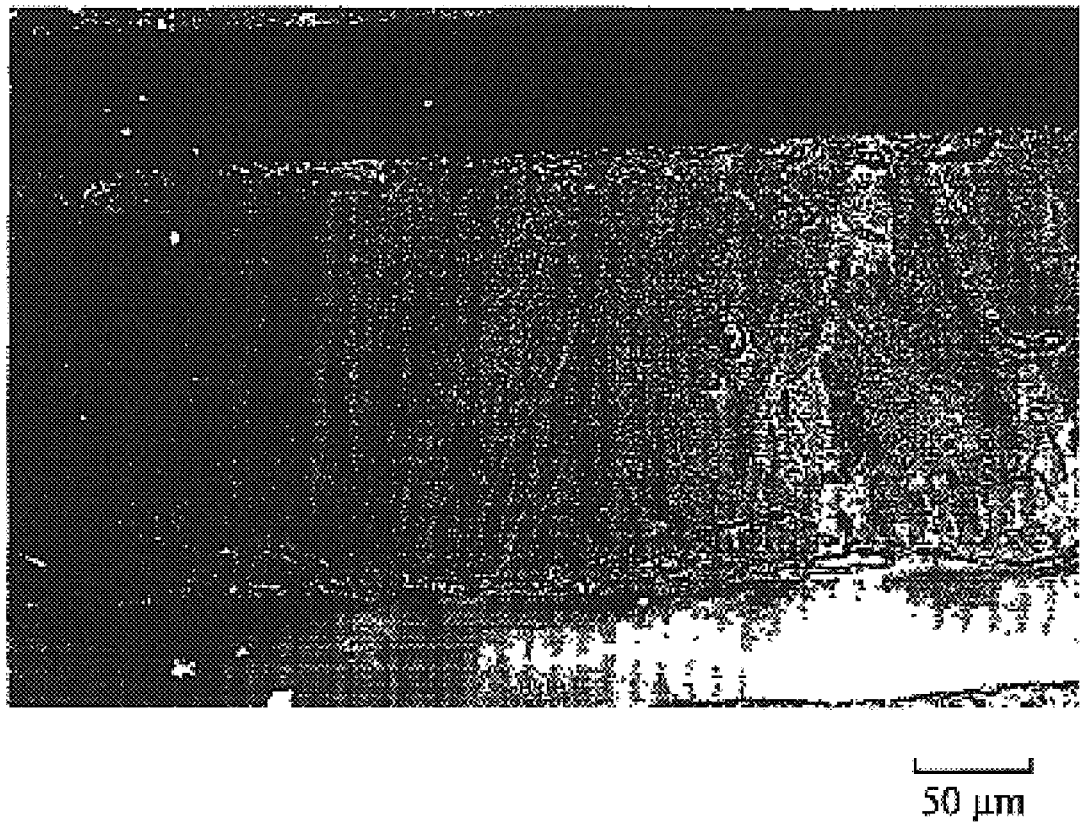
FIG. 2 is a photomicrograph under polarizing microscope of the bonded $Sm_2Co_{17}$ base magnet-forming alloy strip in Comparative Example 1.

An ingot of the same composition as in Example 1 was prepared by placing the charge in an alumina crucible, melting it in an argon atmosphere in a high-frequency heating furnace, and casting from a melt temperature of 1650° C. by a strip casting technique, with a water-cooled single roll being operated at a peripheral speed of 1 m/s. FIG. 2 is a photomicrograph of the ingot under a polarizing microscope. The alloy had a crystal structure having an average grain size of 20 μm and containing 5% by volume of equiaxed crystals with a grain size of 1 to 200 μm and the balance of columnar crystals.

The bonded $Sm_2Co_{17}$ base magnet-forming ingot was heat treated as in Example 1. For the bonded $Sm_2Co_{17}$ base magnet-forming alloy thus obtained, the Sm content was quantified by an ion exchange separation process and the average grain size was measured.

As in Example 1, the bonded $Sm_2Co_{17}$ base magnet-forming alloy was subjected to aging treatment, grinding, mixing with an epoxy resin, kneading, orientation under a magnetic field, and pressure molding. Magnetic properties of the bonded rare earth magnet were similarly measured.

Table 1 shows the Sm content and average grain size of the $Sm_2Co_{17}$ base magnet-forming ingots and the magnetic properties of the bonded rare earth magnets obtained in Example 1 and Comparative Example 1. It is evident from Table 1 that Example 1 is superior in remanence Br, coercivity HcJ and maximum energy product (BH)max to Comparative Example 1.

TABLE 1

| | Average grain size, μm | Sm content, wt % | Br, kG | HcJ, kOe | (BH) max, MGOe |
|---|---|---|---|---|---|
| Example 1 | 50 | 23.8 | 8.5 | 14.2 | 16.7 |
| Comparative Example 1 | 30 | 23.2 | 8.0 | 9.5 | 13.5 |

Example 2

A bonded $Sm_2Co_{17}$ base magnet-forming ingot was prepared by formulating a charge to a composition consisting essentially of 20.0 wt % Sm, 4.0 wt % Ce, 16.0 wt % Fe, 5.0 wt % Cu, 3.0 wt % Zr and the balance Co, placing the charge in an alumina crucible, melting it in an argon atmosphere in a high-frequency heating furnace, and casting from a melt temperature of 1400° C. by a strip casting technique, with a water-cooled single roll being operated at a peripheral speed of 2.5 m/s. The alloy consisted of crystals having an average grain size of 30 μm and containing 80% by volume of equiaxed crystals with a grain size of 1 to 200 μm and the balance of columnar crystals.

Figure 3:
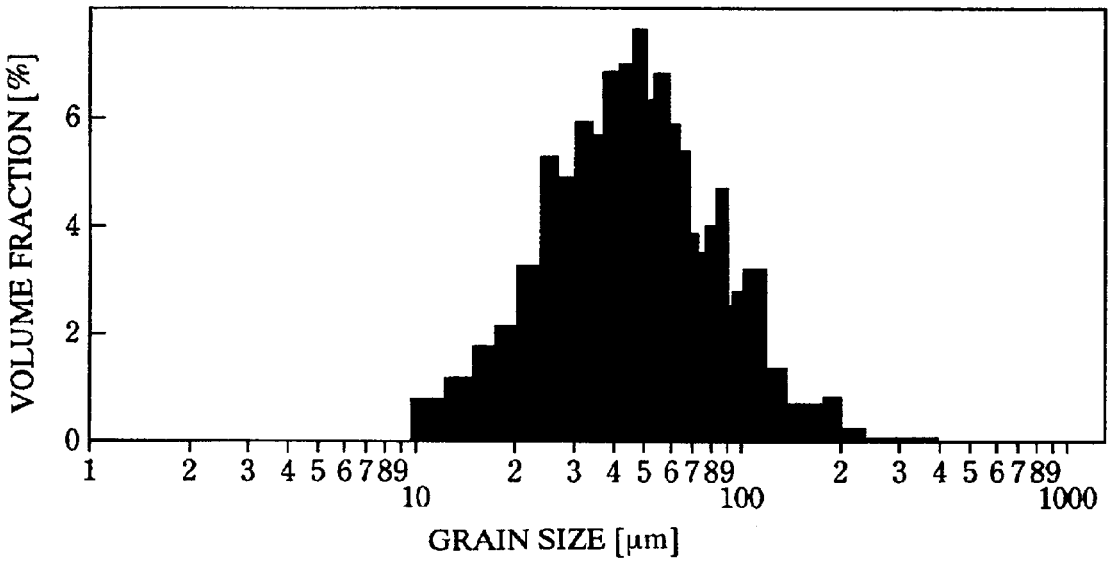
FIG. 3 is a grain size distribution of an alloy strip as heat treated in Example 2.

Using a heat treating furnace, the bonded $Sm_2Co_{17}$ base magnet-forming ingot was heat treated in an argon atmosphere at 1100° C. for 2 hours. At the end of heat treatment, the ingot was quenched. The bonded $Sm_2Co_{17}$ base magnet-forming alloy thus obtained was measured for grain size, examining a grain size distribution. The results are plotted in the diagram of FIG. 3.

The bonded $Sm_2Co_{17}$ base magnet-forming alloy was held in an argon atmosphere at 800° C. for 10 hours, slowly cooled to 400° C. at a descending rate of −1.0° C./min, then ground to a particle size of no more than about 100 μm by a jaw crusher and Brown mill. In this way, a bonded rare earth magnet-forming alloy powder was obtained.

To the alloy powder was added 5% by weight of an epoxy resin. The mixture was kneaded, placed in an applied magnetic field of 10 kOe for orientation, and molded under pressure, obtaining a bonded rare earth magnet. Magnetic properties of the bonded rare earth magnet were measured by means of a B–H tracer.

Comparative Example 2

An ingot of the same composition as in Example 2 was prepared by placing the charge in an alumina crucible, melting it in an argon atmosphere in a high-frequency heating furnace, and casting from a melt temperature of 1240° C. by a strip casting technique, with a water-cooled single roll being operated at a peripheral speed of 50 m/s. The alloy consisted of crystals having an average grain size of 0.5 μm and containing 5% by volume of equiaxed crystals with a grain size of 1 to 200 μm, 90% by volume of equiaxed crystals with a grain size of less than 1 μm, and the balance of columnar crystals.

Figure 4:
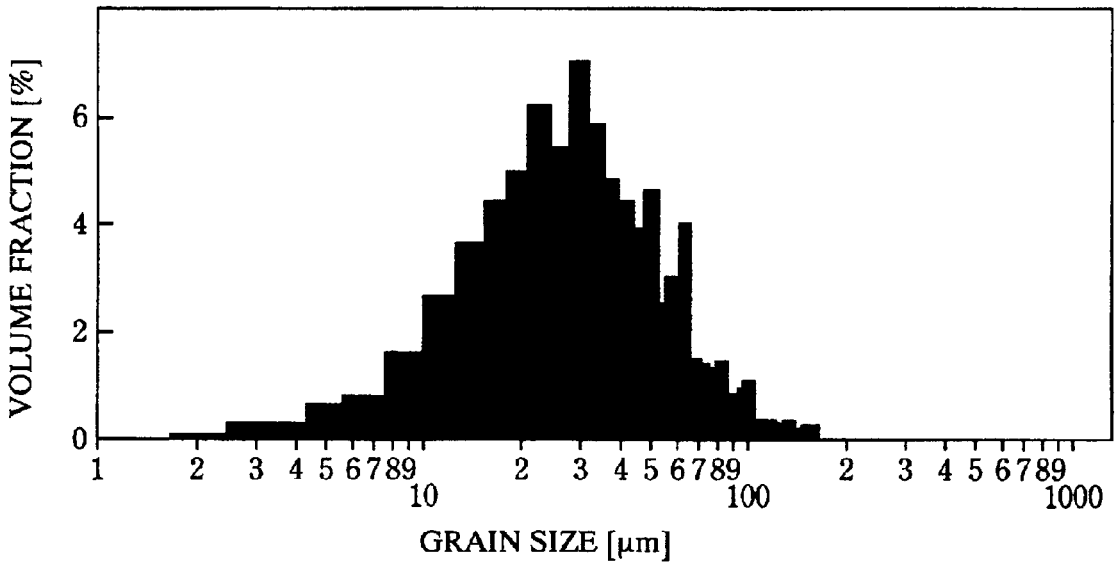
FIG. 4 is a grain size distribution of an alloy strip as heat treated in Comparative Example 2.

The bonded $Sm_2Co_{17}$ base magnet-forming ingot was heat treated as in Example 2. The bonded $Sm_2Co_{17}$ base magnet-forming alloy thus obtained was measured for grain size, examining a grain size distribution. The results are plotted in the diagram of FIG. 4.

As in Example 2, the bonded $Sm_2Co_{17}$ base magnet-forming alloy was subjected to aging treatment, grinding, mixing with an epoxy resin, kneading, orientation under a magnetic field, and pressure molding. Magnetic properties of the bonded rare earth magnet were similarly measured.

Comparative Example 3

Figure 5:
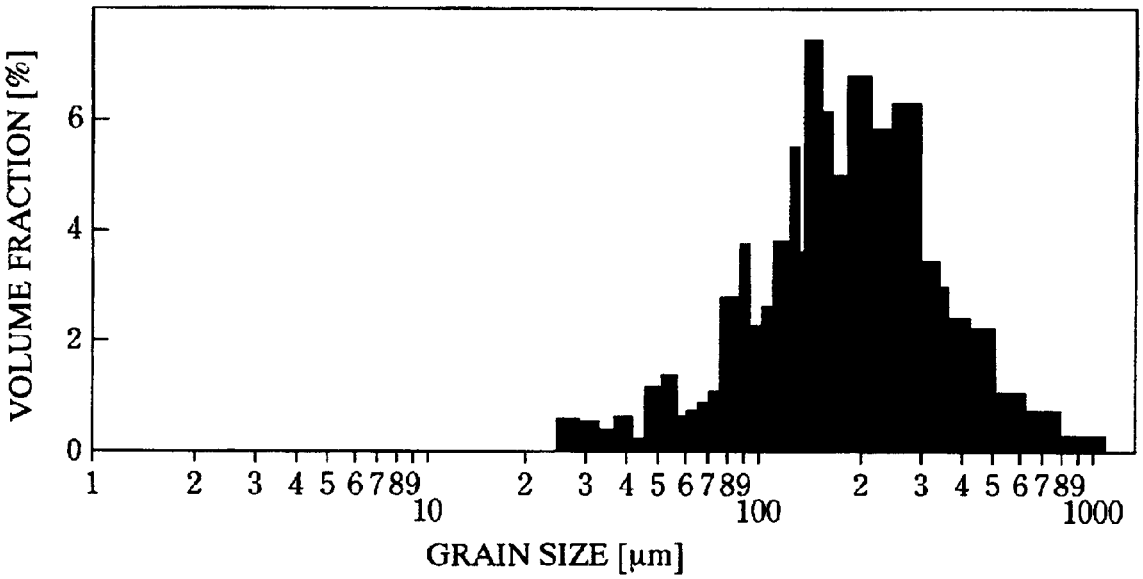
FIG. 5 is a grain size distribution of an alloy strip as heat treated in Comparative Example 3.

A bonded $Sm_2Co_{17}$ base magnet-forming ingot was prepared by placing the charge of the same composition as in Example 2 in an alumina crucible, melting it in an argon atmosphere in a high-frequency heating furnace, and casting in a box-shaped mold of copper so that the ingot had a thickness of 15 mm. The bonded $Sm_2Co_{17}$ base magnet-forming ingot was measured for grain size, examining a grain size distribution. The results are plotted in the diagram of FIG. 5.

As in Example 2, the bonded $Sm_2Co_{17}$ base magnet-forming alloy was subjected to aging treatment, grinding, mixing with an epoxy resin, kneading, orientation under a magnetic field, and pressure molding. Magnetic properties of the bonded rare earth magnet were similarly measured.

Table 2 shows the magnetic properties of the bonded $Sm_2Co_{17}$ base magnets obtained in Example 2 and Comparative Examples 2 and 3. A comparison of FIGS. 3 to 5 reveals that Example 2 gives a uniform distribution centering at 50 μm whereas Comparative Example 2 gives a wide distribution with more contents of fine grains. The grain size of Comparative Example 3 is very large. Reflecting the grain size distribution, Example 2 exhibits superior remanence, coercivity and maximum energy product to Comparative Examples 2 and 3.

TABLE 2

| | Br, kG | HcJ, kOe | (BH) max, MGOe |
|---|---|---|---|
| Example 2 | 7.9 | 13.9 | 14.5 |
| Comparative Example 2 | 7.4 | 13.5 | 10.9 |
| Comparative Example 3 | 7.5 | 9.8 | 11.1 |

The bonded $Sm_2Co_{17}$ base magnet-forming powders and the bonded $Sm_2Co_{17}$ base magnets prepared using the same according to the invention have excellent magnetic properties.

Japanese Patent Application No. 2001-161165 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for preparing an alloy for bonded rare earth magnets, comprising the steps of:

melting an alloy consisting essentially of 20 to 30% by weight of R which is samarium or a mixture of at least two rare earth elements (inclusive of Y) containing at least 50% by weight of samarium, 10 to 45% by weight of iron, 1 to 10% by weight of copper, 0.5 to 5% by weight of zirconium, and the balance of cobalt, quenching the melt by a strip casting technique, to form a rare earth alloy strip containing at least 20% by volume of equiaxed crystals with a grain size of 1 to 200 $\mu$m and having a gage of 0.05 to 3 mm, heat treating the strip in a non-oxidizing atmosphere at 1000 to 1300° C. for 0.5 to 20 hours, followed by aging treatment and grinding.

2. A method for preparing an alloy for bonded rare earth magnets, comprising the steps of:

melting an alloy consisting essentially of 20 to 30% by weight of R which is samarium or a mixture of at least two rare earth elements (inclusive of Y) containing at least 50% by weight of samarium, 10 to 45% by weight of iron, 1 to 10% by weight of copper, 0.5 to 5% by weight of zirconium, and the balance of cobalt, quenching the melt from a melt temperature of 1250 to 1600° C. by a strip casting technique, heat treating the resulting rare earth alloy in a non-oxidizing atmosphere at 1000 to 1300° C. for 0.5 to 20 hours, followed by aging treatment and grinding.

3. A method for making a magnet composition, comprising:

preparing an alloy for bonded rare earth magnets, comprising the steps of melting an alloy consisting essentially of 20 to 30% by weight of R which is samarium or a mixture of at least two rare earth elements (inclusive of Y) containing at least 50% by weight of samarium, 10 to 45% by weight of iron, 1 to 10% by weight of copper, 0.5 to 5% by weight of zirconium, and the balance of cobalt, quenching the melt by a strip casting technique, to form a rare earth alloy strip containing at least 20% by volume of equiaxed crystals with a grain size of 1 to 200 $\mu$m and having a gage of 0.05 to 3 mm, heat treating the strip in a non-oxidizing atmosphere at 1000 to 1300° C. for 0.5 to 20 hours, followed by aging treatment and grinding; and mixing the alloy with resin to form a magnet composition comprising 1 to 10% by weight of said resin.

4. The method of claim 1 wherein the melting is done at 1300° C. to 1600° C.

5. The method of claim 1 wherein the quenching is done at 1250° C. to 1600° C.

6. The method of claim 3 wherein the resin comprises a resin selected from the group consisting of: epoxy resin, nylon resin, acrylic resin, polyurethane resin, silicone resin, polyester resin, polyimide resin, polyethylene resin and polypropylene resin.

* * * * *